US009359920B2

(12) United States Patent
Yamada et al.

(10) Patent No.: US 9,359,920 B2
(45) Date of Patent: Jun. 7, 2016

(54) VARIABLE VALVE ACTUATING MECHANISM FOR OHV ENGINE

(71) Applicant: HONDA MOTOR CO., LTD., Tokyo (JP)

(72) Inventors: Yoshikazu Yamada, Saitama (JP); Mashu Kurata, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 57 days.

(21) Appl. No.: 14/514,504

(22) Filed: Oct. 15, 2014

(65) Prior Publication Data

US 2015/0184556 A1 Jul. 2, 2015

(30) Foreign Application Priority Data

Dec. 26, 2013 (JP) ..... 2013-269949

(51) Int. Cl.

| | |
|---|---|
| ***F01L 1/34*** | (2006.01) |
| ***F01L 1/053*** | (2006.01) |
| ***F01L 1/14*** | (2006.01) |
| ***F01L 13/00*** | (2006.01) |
| *F01L 1/38* | (2006.01) |
| *F02B 75/02* | (2006.01) |
| *F02B 25/04* | (2006.01) |
| *F02D 13/02* | (2006.01) |

(52) U.S. Cl.

CPC . *F01L 1/34* (2013.01); *F01L 1/053* (2013.01); *F01L 1/146* (2013.01); *F01L 13/0036* (2013.01); *F01L 1/38* (2013.01); *F02B 25/04* (2013.01); *F02B 2075/025* (2013.01); *F02D 13/0265* (2013.01)

(58) Field of Classification Search

CPC ..... F01L 1/34; F01L 1/053; F01L 13/0036; F01L 1/146; F01L 1/38; F02B 2075/025

USPC ..... 123/90.15, 90.16

See application file for complete search history.

(56) References Cited

U.S. PATENT DOCUMENTS

2012/0152194 A1* 6/2012 Arai ..... F01L 1/146 123/90.15

FOREIGN PATENT DOCUMENTS

JP 2012-7596 A 1/2012

* cited by examiner

*Primary Examiner* — Zelalem Eshete

(74) *Attorney, Agent, or Firm* — Westerman, Hattori, Daniels & Adrian, LLP

(57) ABSTRACT

An OHV engine comprises a first and second cam carried by a camshaft rotatably supported by a crankcase to be rotatively actuated by a crankshaft, first and second lower rocker arms pivotally supported by a lower rocker shaft adjacent to each other, and configured to be actuated by the first and second cams, respectively, a clutch member mounted on the second rocker arm in an axially slidable and rotationally fast manner, the clutch member being axially moveable between an engaged position and a disengaged position, the clutch member being provided with an engagement recess configured to receive a corresponding engagement projection of the first lower rocker arm for a joint pivotal movement of the first and second lower rocker arms when the clutch member is at the engaged position, and an actuator for causing the clutch member to move axially between the engaged position and the disengaged position.

8 Claims, 12 Drawing Sheets

E
5
6
54b
52
54
53
54a
55a
39
39
4
36
56
3
1
35
9
9
34
33
2
17a
17
8(66)
7
61
18
9
7S
B1
64a
8X
55
15
64f
60
55b
64c
V
V
79
64e
64b
71
64d
9
63
58 exhaust valve open range (angle)
startup/low-load operation (1st cam)

exhaust valve open range (angle)
high-speed/high-load operation (2nd cam)

VARIABLE VALVE ACTUATING MECHANISM FOR OHV ENGINE

TECHNICAL FIELD

The present invention relates to a variable valve actuating mechanism for an OHV engine that can vary the lift of an exhaust valve or an intake valve depending on an operating condition of the engine.

BACKGROUND OF THE INVENTION

In the field of four-stroke self-ignition engines, variable valve actuating mechanisms that can change the valve timings of the intake valves and the exhaust valves with a good response have been proposed. See JP2012-7596A, for instance. The variable valve actuating mechanism proposed in this patent publication is applied to an OHV (over head valve) engine in which upper rocker arms provided above the cylinder head for actuating the intake valve and the exhaust valve are actuated by a camshaft provided in the crankcase via pushrods. The variable valve actuating mechanism is provided in association with lower rocker arms interposed between the camshaft and the pushrods.

More specifically, the variable valve actuating mechanism disclosed in JP2012-7596A comprises a composite camshaft consisting of a first camshaft rotatively actuated by the crankshaft via a timed transmission mechanism and provided with low profile cams and a second camshaft passed coaxially through the first camshaft and provided with high profile cams. The second camshaft is rotatably supported by a fixed part of the engine, and the first cam shaft is rotatably supported by the second camshaft. An axial end of the first camshaft is provided with an engagement recess while the adjoining part of the second camshaft is provided with a clutch member that can be selectively placed in an engaged position for connecting the first and second camshafts at a fixed phase relationship and a disengaged position for disconnecting the second camshaft from the first camshaft. Thus, the high profile cams determine the cam lifts when the two camshafts are connected to each other, and the high profile cams on the second camshaft become ineffective when the second camshaft is disconnected from the first camshaft, leaving the low profile cams to determine the cam lifts.

This previously proposed variable valve actuating mechanism however suffers from the problem of high complexity as the two separate camshafts each provided with cams are required, and have to be combined coaxially in a highly complex manner. Therefore, this mechanism is not suitable for small engines such as uni-flow two-stroke engines, and a more simple and compact variable valve actuating mechanism is desired.

SUMMARY OF THE INVENTION

In view of such problems of the prior art, a primary object of the present invention is to provide a variable valve actuating mechanism for OHV engines which is more simple and compact.

A second object of the present invention is to provide a variable valve actuating mechanism which is suitable for use in small engines.

Such objects of the present invention can be accomplished by providing a variable valve actuating mechanism for an OHV engine, comprising: a camshaft rotatably supported by a crankcase to be rotatively actuated by a crankshaft of the engine; a first cam carried by the camshaft; a first lower rocker arm pivotally supported by a lower rocker shaft supported by the crankcase, and configured to be actuated by the first cam at a first end thereof; a pushrod having a lower end engaged by a second end of the first lower rocker arm; an upper rocker arm pivotally supported by an upper rocker shaft supported by a cylinder head and having a first end engaged by an upper end of the pushrod; an engine valve provided in the cylinder head, and configured to be actuated by a second end of the upper rocker arm; a second cam carried by the camshaft coaxially to and adjacent to the first cam and having an at least partly greater cam profile than the first cam; a second lower rocker arm pivotally supported by the lower rocker shaft adjacent to the first lower rocker arm, and configured to be actuated by the second cam at a first end thereof; a clutch member mounted on the second rocker arm in an axially slidable and rotationally fast manner, the clutch member being axially moveable between an engaged position and a disengaged position, the clutch member being provided with an engagement feature which engages a corresponding engagement feature of the first lower rocker arm for a joint pivotal movement of the first and second lower rocker arms when the clutch member is at the engaged position; and an actuator for causing the clutch member to move axially between the engaged position and the disengaged position.

The term "OHV engine" as used herein means any engine that has an engine valve in the cylinder head, and a camshaft in a lower part of the engine, and may consist of either a four-stroke engine or a two-stroke engine. A greater cam profile gives rises to an increased lift which as used herein means that the valve lift can be increased either in terms of the maximum valve lift and/or the angular range in which the valve is opened. Therefore, a greater valve lift may mean a greater maximum valve lift and/or a larger open valve angular range.

According to the present invention, when the clutch member is disengaged from the first lower rocker arm, the first and second lower rocker arms are disconnected from each other so that the pushrod is driven by the first lower rocker arm which follows the cam profile of the first cam while the second lower rocker arm undergoes a lost motion. When the clutch member is engaged with the first lower rocker arm, the first and second lower rocker arms are integrally connected to each other so that the pushrod is driven by the first lower rocker arm which is integrally joined to the second lower rocker arm, the second lower rocker arm following the cam profile of the second cam which is at least partly greater than that of the first cam.

The actuator may comprise a shift member guided for an axial movement and configured to engage the clutch member for a joint axial movement, a spring member urging the clutch member toward one of the engaged and disengaged positions, and a cam configured to cause an axial movement of the shift member toward the other of the engaged and disengaged positions against a spring force of the spring member.

Thus, the clutch member can be shifted between the engaged position and the disengaged position by using a mechanism which is highly simple and reliable.

The shift member may comprise a shift plate having an inner arcuate edge while the clutch member is provided with a circumferential groove on an outer circumference thereof that receives the inner arcuate edge of the shift plate for the joint axial movement.

Thus, the shift member can engage the clutch member in the axial direction with a large contact area while permitting a pivoting movement of the clutch member with a minimum friction.

According to a preferred embodiment of the present invention, the shift plate is guided by a pair of guide rods that guide the shift plate at positions thereof located on either side of the arcuate edge thereof.

Thereby, the attitude of the shift member can be kept fixed in a stable manner during the guided motion thereof so that the tilting movement of the shift member can be avoided, and the resistance to the axial movement of the shift member can be minimized.

According to a particularly preferred embodiment of the present invention, the engagement feature of the clutch member comprises an axial engagement recess, and the corresponding engagement feature of the first lower rocker arm comprises an axial projection configured to be received in the engagement recess in an at least partly complementary manner, the engagement recess being provided with a pair of slopes on either side of an open end thereof.

Thereby, the engagement projection can be smoothly fitted into the engagement recess when the clutch member is brought to the engaged position, and can be retained in the engagement recess in a stable manner once the clutch member has reached the engaged position.

According to a preferred embodiment of the present invention, the clutch member is provided with a splined inner bore, and the second lower rocker arm is provided with a corresponding splined tubular portion which is received in the splined inner bore, the second lower rocker arm being provided with an axial recess for permitting the clutch member to move between the engaged position and the disengaged position axially along the corresponding splined tubular portion without interfering with the second lower rocker arm.

Thereby, the clutch member can be moved between the engaged position and the disengaged position by an adequate stroke by using a highly simple structure.

In order to maintain the second lower rocker arm to be in an appropriate position for the engagement projection of the first lower rocker arm to be fitted into the engagement recess of the clutch member when the clutch member is shifted from the disengaged position to the engaged position, the variable valve actuating mechanism may further comprise a lost motion spring that urges the first end of the second lower rocker arm against the second cam.

According to a particularly preferred embodiment of the present invention, the engine valve comprises an exhaust valve, the OHV engine consists of a uni-flow type, two-stroke engine, and the camshaft is integrally formed with the crankshaft.

BRIEF DESCRIPTION OF THE DRAWINGS

Now the present invention is described in the following with reference to the appended drawings, in which.

DESCRIPTION OF THE PREFERRED EMBODIMENT(S)

The present invention is described in the following with respect to a uni-flow type, single cylinder, two-stroke engine (engine E).

Figure 1:
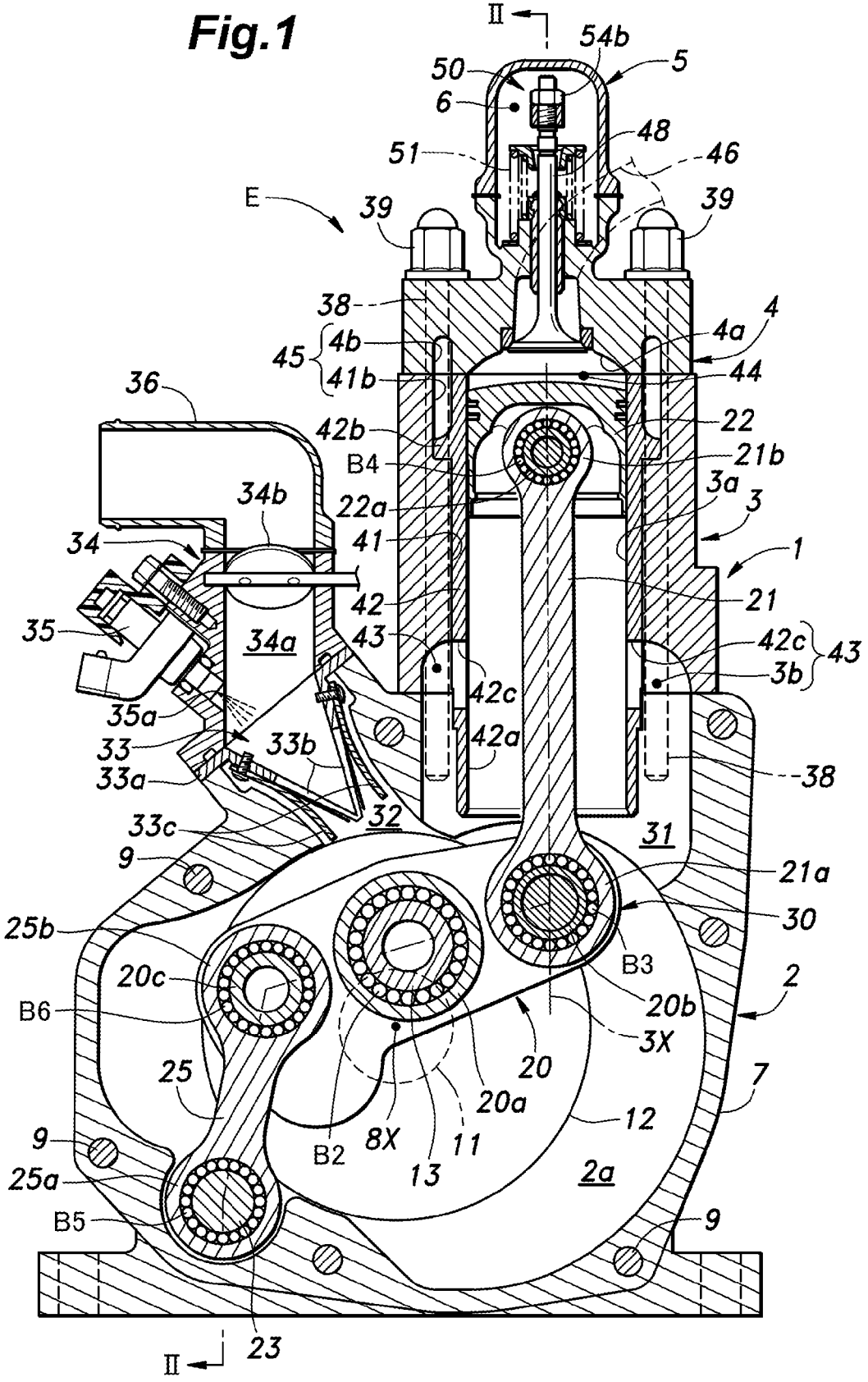
FIG. 1 is a vertical sectional view of an engine embodying the present invention (taken along line I-I of FIG. 2)
Figure 2:
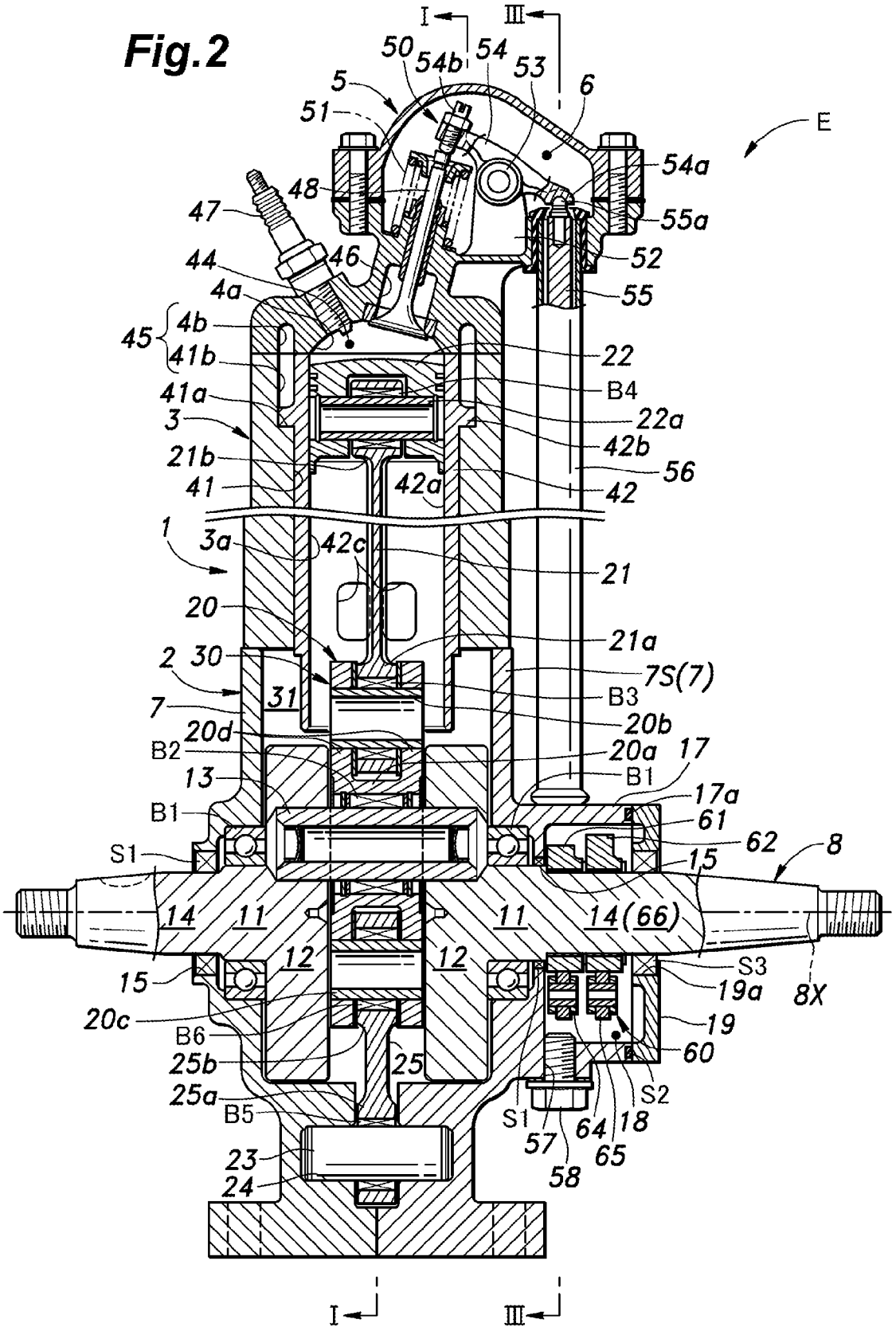
FIG. 2 is a sectional view taken along line II-II of FIG. 1.

Referring to FIGS. 1 and 2, an engine main body 1 of the engine E is provided with a crankcase 2 defining a crank chamber 2*a* therein, a cylinder block 3 connected to the upper end of the crankcase 2 and defining a cylinder bore 3*a* therein, a cylinder head 4 connected to the upper end of the cylinder block 3 and a head cover 5 attached to the upper end of the cylinder head 4 to define an upper valve chamber 6 in cooperation with the cylinder head 4. In the illustrated embodiment, the engine E is positioned such that the cylinder axial line 3X is directed vertically with the cylinder head 4 at the top. The following description is based on this orientation of the engine E for the convenience of description, but the present invention is not limited by this orientation, but the cylinder axial line 3X may be directed in any direction, horizontally or at an angle to the vertical direction.

Figure 3:
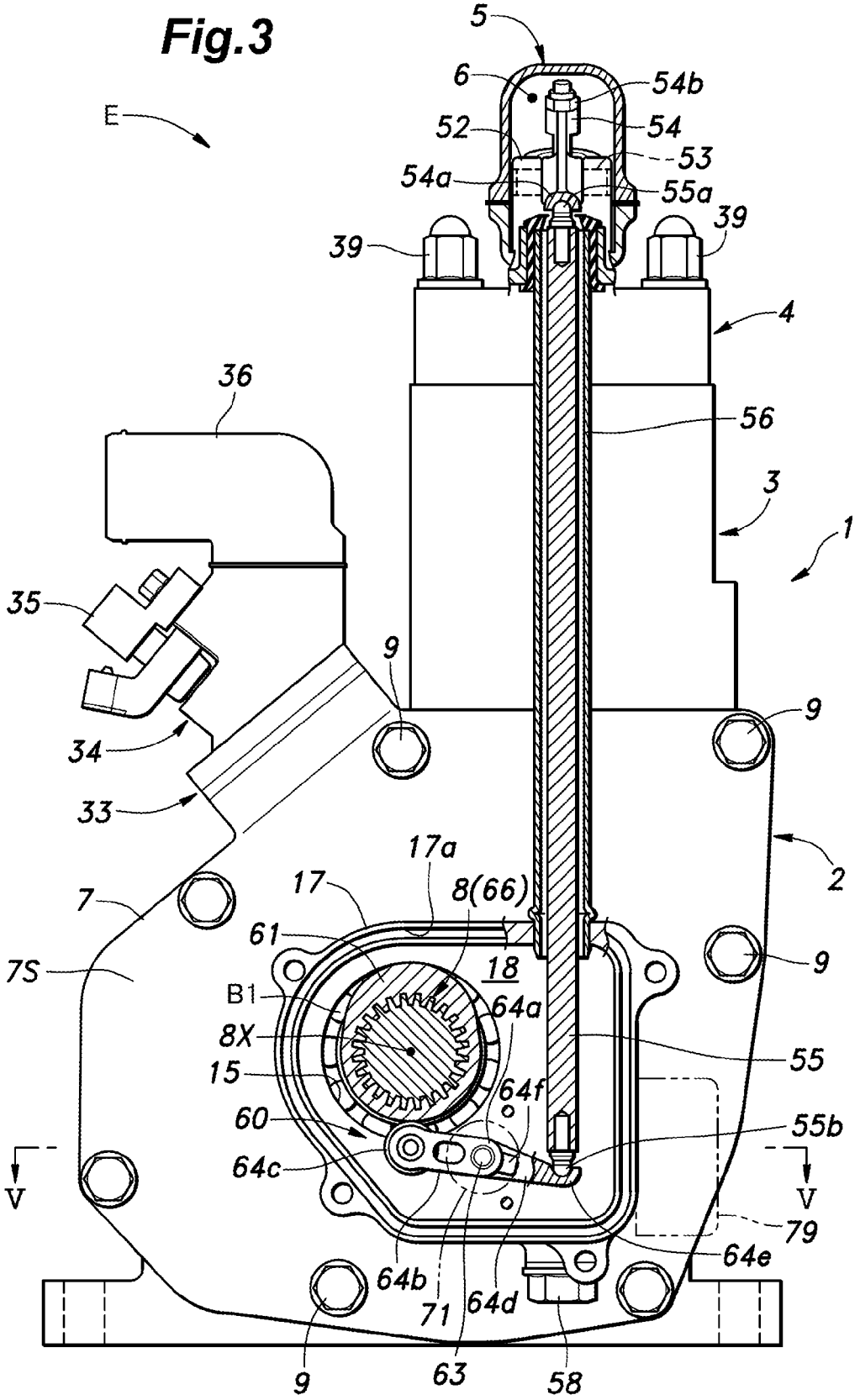
FIG. 3 is a sectional view taken along line III-III of FIG. 2.

As best shown in FIG. 2, the crankcase 2 consists of two crankcase halves 7 having a parting plane extending perpendicularly to the crankshaft axial line 8X and joined to each other by seven threaded bolts 9 (FIGS. 1 and 3). Each crankcase half 7 includes a side wall 7S which is provided with an opening through which the corresponding end of a crankshaft 8 projects, and the corresponding end of the crankshaft 8 is rotatably supported by the side wall 7S via a first bearing B1. Thus, the crankshaft 8 is rotatably supported at two ends thereof by the crankcase 2, and has a crank throw received in the crank chamber 2*a* defined by the crankcase 2.

The crankshaft 8 includes a pair of journals 11 that are rotatively supported by the first bearings B1, respectively, a pair of crank webs 12 extending radially from middle parts of the crankshaft 8, a crankpin 13 extending between the two webs 12 radially offset from and in parallel with the axial line 8X of the crankshaft 8, and a pair of extensions 14 extending coaxially from the outer ends of the journals 11 out of the crankcase 2. Each crank web 12 is formed as a disk defining a larger radius than the outer profile of the crankpin 13 so as to serve as a flywheel that stabilizes the rotation of the crankshaft 8.

Each extension 14 of the crankshaft 8 extends out of the crankcase 2 via a through hole 15 formed in the side wall 7S of the corresponding crankcase half 7. The outer side of each ball bearing B1 is fitted with a seal S1 to ensure an air tight seal of the crank chamber 2*a*. As shown in FIGS. 2 and 3, the side wall 7S of the right crankcase half 7 is integrally formed with a lower valve case 17 protruding therefrom so as to surround the right extension 14 of the crankshaft 8 as seen in FIG. 2.

The lower valve case 17 is cylindrical in shape with an open outer axial end, and internally defines a lower valve chamber 18. The opening of the outer end of the lower valve case 17 is closed by a valve chamber lid 19. The outer axial end of the lower valve case 17 is provided with an annular seal groove 17*a* so that the valve chamber lid 19 may be joined to the opening of the lower valve case 17 in an air tight manner via a second seal member S2 received in the seal groove 17*a*.

The right end of the crankshaft 8 as seen in FIG. 2 is passed through a through hole 19*a* formed in the valve chamber lid 19, and extends further outward. The inner circumference of the through hole 19*a* is provided with a third seal member S3 for ensuring the airtight condition of the lower valve case 17, and hence the airtight condition of the crank chamber 2*a*.

As shown in FIG. 1, the central axial line 8X of the crankshaft 8 or the axial center of the journals 11 is offset from the cylinder axial line 3X to a side (left side in FIG. 1). The crankpin 13 rotates around the axial center 8X of the crankshaft 8 as the crankshaft 8 rotates, and rotatably supports a middle point of a trigonal link 20 via a tubular portion 20*a* of the trigonal link 20. A second bearing B2 is interposed between the crankpin 13 and the tubular portion 20*a*.

The trigonal link 20 includes a pair of plates 20*d* that are joined by the tubular portion 20*a* in a mutually parallel relationship, and a pair of connecting pins (a first connecting pin 20*b* and a second connecting pin 20*c*) fixedly passed between the two plates 20*d*. These connecting pins 20*b* and 20*c* and the crankpin 13 form three pivot points that are arranged in a line at a substantially same interval with the crankpin 13 located in the middle.

The first connecting pin 20*b* located on the side of the cylinder axial line 3X is pivotally connected to a big end 21*a* of a connecting rod 21 via a third bearing B3. A small end 21*b* of the connecting rod 21 is pivotally connected to a piston 22 slidably received in the cylinder bore 3*a* via a piston pin 22*a* and a fourth bearing B4.

A pivot shaft 23 is fixedly provided in a lower part of the crankcase 2, on the side remote from the first connecting pin 20*b*. The rotational center lines of the pivot shaft 23 and the three pivot points (20*a*, 20*b* and 20*c*) are all in parallel to one another. As shown in FIG. 2, the pivot shaft 23 is press fitted into a pair of mutually opposing holes 24 formed in the two halves of the crankcase 2, respectively. A base end 25*a* of a swing link 25 is pivotally connected to the pivot shaft 23 via a fifth bearing B5. The swing link 25 extends substantially upward from the base end 25*a* thereof, and an upper end or a free end 25*b* of the swing link 25 is pivotally supported by the second connecting pin 20*c* (remote from the cylinder axial line 3X) via a sixth bearing B6.

The engine E is thus provided with a multiple link mechanism 30 which includes the trigonal link 20 and the swing link 25 in addition to the connecting rod 21. The multiple link mechanism 30 converts the linear reciprocating movement of the piston 22 into a rotational movement of the crankshaft 8. The dimensions and positions of the various components of the multiple link mechanism 30 are selected and arranged such that a prescribed compression ratio selected for the properties of the particular fuel may be achieved. The compression ratio is selected such that the pre-mixed mixture may self-ignite in an appropriate manner. The fuels that may be used for this engine include gasoline, diesel fuel, kerosene, gas (utility gas, LP gas and so on), etc.

Owing to the use of the multiple link mechanism 30, for the given size of the engine E, the piston stroke L can be maximized so that a larger part of the thermal energy can be converted into kinetic energy, and the thermal efficiency of the engine E can be improved. More specifically, as shown in part (A) of FIG. 4, when the piston 22 is at the top dead center, the big end 21*a* of the connecting rod 21 which is connected to the first connecting pin 20*b* at the right end of the trigonal link 20 is located higher than the crankpin 13 by a first distance D1. Furthermore, as shown in part (B) of FIG. 4, when the piston 22 is at the bottom dead center, the big end 21*a* of the connecting rod 21 is located lower than the crankpin 13 by a second distance D2. Therefore, as compared to the conventional engine where the big end 21*a* of the connecting rod 21 is directly connected to the crankpin 13, the piston stroke L can be extended by the sum of these two distances or by D1+D2. Therefore, the piston stroke L of the engine E can be extended without increasing the size of the crankcase 2 or the overall height of the engine E.

Figure 4:
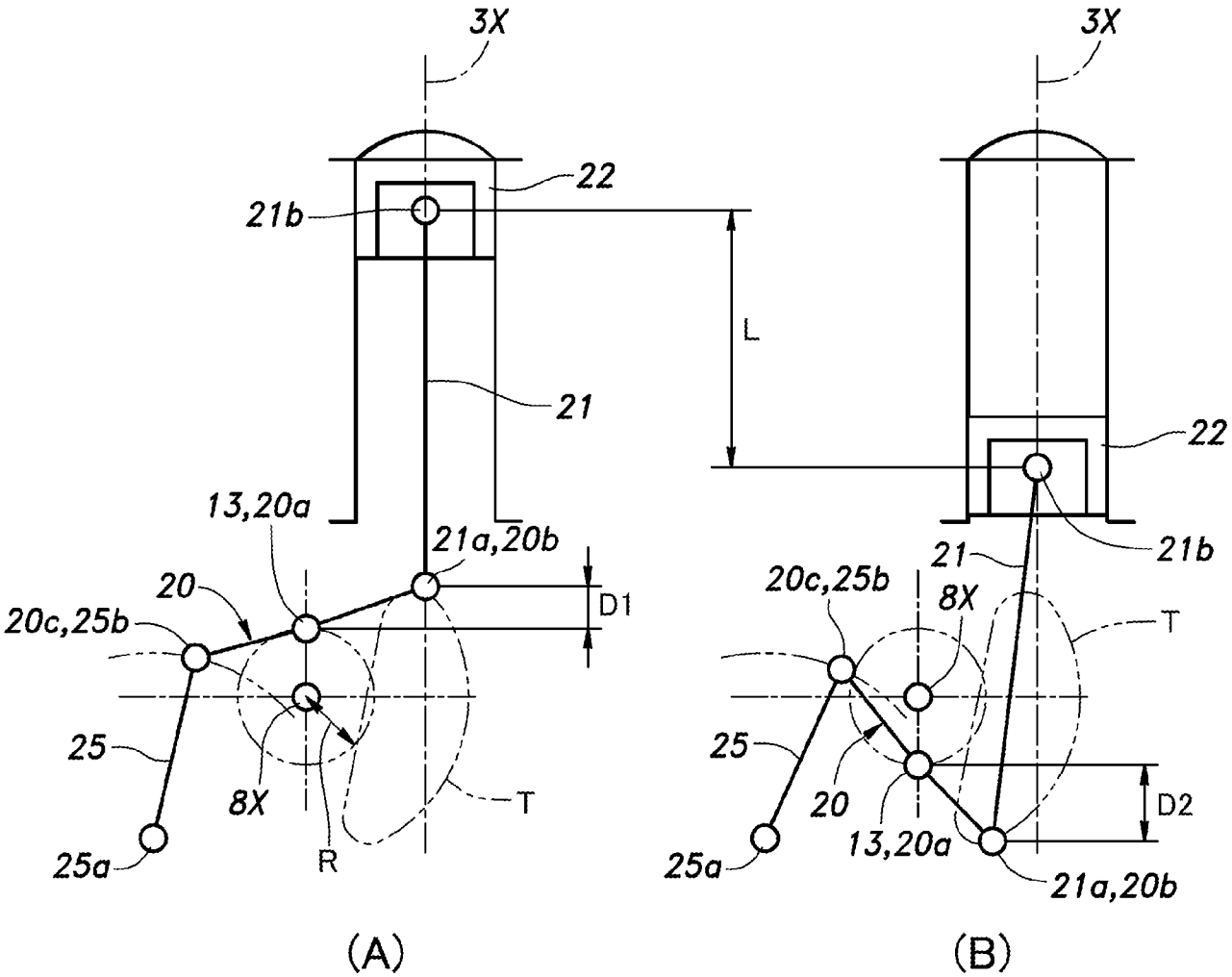
FIG. 4 is a diagram showing the mode of operation of a multiple linkage mechanism used in the engine.

In this engine E, the trajectory T of the big end 21*a* of the connecting rod 21 is vertically elongated, instead of being truly circular, as shown in (A) and (B) of FIG. 4. In other words, as compared to the more conventional reciprocating engine having the constant crank radius R, the swing angle of the connecting rod 21 is reduced. Therefore, the interferences between the lower end of the cylinder (or lower end of the cylinder sleeve 42) and the connecting rod 21 can be avoided even when the cylinder bore 3*a* is relatively small. Furthermore, the reduction in the swing angle of the connecting rod 21 contributes to the reduction in the thrust loads which the piston 22 applies to the two sides (thrust side and anti-thrust side) of the cylinder wall.

As shown in FIG. 1, the crank chamber 2*a* is laterally extended in the region of the swing link 25 and is vertically extended in the region directly under the piston 22 so that the trigonal link 20 that undergoes a composite rotational movement, the swing link 25 that undergoes a swinging movement and the connecting rod 21 that undergoes a vertically elongated circular movement may not interfere with one another. The part of the crankcase 2 adjoining the lower end of the cylinder bore 3*a* is formed with a cylindrical recess 31 having a circular cross section (taken along a horizontal plane) substantially coaxial with the cylinder bore 3*a* and surrounding the lower end of the cylinder sleeve 42 such that an annular space communicating with the crank chamber 2*a* is defined around the lower end of the cylinder sleeve 42.

An intake port 32 is formed by a tubular extension of the crankcase 2 extending obliquely upward adjacent to the cylindrical recess 31 on the side of the swing link 25. The intake port 32 is fitted with a reed valve 33 that permits the flow of air from the intake port 32 to the crank chamber 2*a*, and prohibits the flow of air in the opposite direction. The reed valve 33 includes a base member 33*a* consisting of a wedge shaped member having a pointed end directed inward and a pair of openings defined on either slanted sides thereof, a pair of valve elements 33*b* mounted on the base member 33*a* so as to cooperate with the openings thereof and a pair of stoppers 33*c* placed on the backsides of the valve elements 33*b* so as to limit the opening movement of the valve elements 33*b* within a prescribed limit. The reed valve 33 is normally closed, and opens when the piston 22 moves upward and the internal pressure in the crank chamber 2*a* thereby drops.

To the outer end of the intake port 32 is connected a throttle body 34 so as to define an intake passage 34*a* extending vertically as a smooth continuation of the intake port 32. A throttle valve 34*b* is pivotally mounted on a horizontal shaft for selectively closing and opening the intake passage 34*a*. A fuel injector 35 is also mounted on the throttle body 34 with an injection nozzle 35*a* thereof directed into a part of the intake passage 34*a* somewhat downstream of the throttle valve 34*b*. The axial line of the fuel injector 35 is disposed obliquely so as to be directed to the reed valve 33, and fuel is injected into the intake passage 34*a* in synchronism with the opening of the reed valve 33. The upstream end of the throttle body 34 is connected to an L shaped intake pipe 36 including a vertical section connected to the throttle body 34 and a horizontal section extending away from the cylinder block 3.

Figure 5:
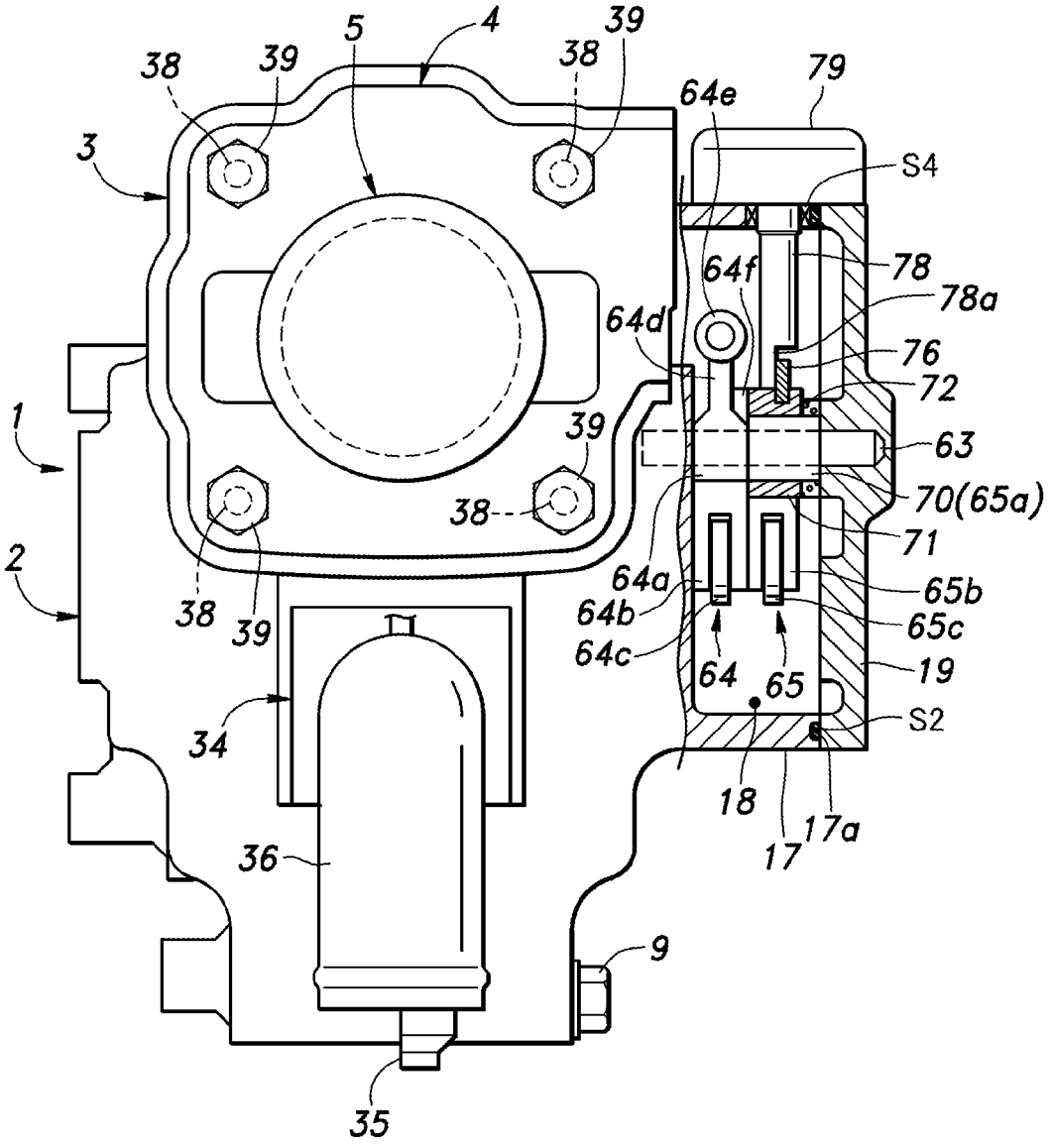
FIG. 5 is a sectional view taken along line V-V of FIG. 3.

Four stud bolts 38 are secured to the upper side of the crankcase 2 and extend upward around the cylinder bore 3*a* at a regular interval as can be seen from FIGS. 1 and 5. The cylinder block 3 and the cylinder head 4 are secured to the crankcase 2 by passing the stud bolts 38 therethrough and threading acorn nuts 39 onto the upper ends of the stud bolts 38.

As shown in FIGS. 1 and 2, the cylinder block 3 is provided with a bore 41 having a circular cross section passed therethrough, and the cylinder sleeve 42 is fitted into this bore 41 with the lower end thereof extending into the cylindrical recess 31 mentioned above. The bore 41 is provided with a large diameter section in an upper end thereof defining an annular shoulder 41*a* facing upward, and the cylinder sleeve 42 is provided with a radial flange 42*b* configured to rest on this annular shoulder 41*a*. The upper end part of the cylinder sleeve 42 (or the part thereof located above the radial flange 42*b*) defines an annular space 41*b* in cooperation with the large diameter section of the bore 41 of the cylinder block 3.

The cylinder sleeve 42 is provided with a constant inner diameter over the entire length thereof except for the lower end thereof which is chamfered, and the cylinder bore 3*a* is defined by an inner circumferential surface 42*a* of the cylinder sleeve 42. The outer diameter of the cylinder sleeve 42 is also constant over the entire length thereof except for the lower end thereof which is reduced in diameter over a certain length and a part adjacent to the upper end thereof which is provided with the annular flange 42*b* defining an annular shoulder surface abutting the annular shoulder 41*a* to determine the axial position of the cylinder sleeve 42 relative to the cylinder block 3. The upper end of the cylinder sleeve 42 is flush with the upper end surface of the cylinder block 3, and the cylinder sleeve 42 is provided with a somewhat greater vertical dimension than the cylinder block 3 so that the lower end of the cylinder sleeve 42 projects out of the lower end of the cylinder block 3 into the cylindrical recess 31 of the crankcase 2.

The front and rear sides of the lower part of the cylinder sleeve 42 is provided with scavenging orifices 42*c* having an upper edge located somewhat higher than the interface between the cylinder block 3 and the crankcase 2. The two scavenging orifices 42*c* are identical in shape and dimensions, and are located at diagonally opposite positions with respect to the cylinder axial line 3X at the same elevation. As shown in FIG. 2, each scavenging orifice 42*c* consists of a pair of rectangular openings separated by a vertical bar and positioned laterally next to each other.

As shown in FIG. 1, the part of the cylinder block 3 opposing each scavenging orifice 42*c* is formed with a recess 3*b* defined by a curved wall surface which is configured to guide the mixture from the crank chamber 2*a* smoothly into the scavenging orifices 42*c*. In other words, each scavenging orifice 42*c* and the corresponding recess 3*b* jointly form a scavenging port 43 that communicates the crank chamber 2*a* and the cylinder bore 3*a* with each other via the cylindrical recess 31. In particular, each scavenging port 43 communicates the crank chamber 2*a* and the cylinder bore 3*a* (or the combustion chamber 44 thereof defined above the piston 22) via the cylindrical recess 31 during a late part of the downward stroke of the piston 22 and an early part of the upward stroke of the piston 22 so that the scavenging port is opened and closed by the piston 22 as the piston 22 moves up and down.

As shown in FIGS. 1 and 2, the part of the lower surface of the cylinder head 4 corresponding to the cylinder bore 3*a* is recessed in a dome-shape (dome-shaped recess 4*a*) so as to define a combustion chamber 44 jointly with the top surface of the piston 22. An annular groove 4*b* is formed in the lower surface of the cylinder head 4 concentrically around the dome-shaped recess 4*a* which aligns with the annular space 41*b* defined between the upper part of the cylinder sleeve 42 and the surrounding wall of the cylinder block 3 such that a water jacket 45 surrounding the dome-shaped recess 4*a* of the cylinder head 4 and the upper part of the cylinder bore 3*a* is defined jointly by the annular space 41*b* and the annular groove 4*b*.

The cylinder head 4 is further provided with an exhaust port 46 opening out at the top end of the combustion chamber 44 and a plug hole for receiving a spark plug 47 therein. In the illustrated embodiment, the spark plug 47 is normally activated only at the time of starting the engine to ignite the mixture in the combustion chamber 44. The exhaust port 46 is provided with an exhaust valve 48 consisting of a poppet valve to selectively close and open the exhaust port 46. The exhaust valve 48 includes a valve stem which is slidably guided by the cylinder head 4 at an angle to the cylinder axial line 3X, and the stem end of the exhaust valve 48 extends into the upper valve chamber 6 containing a part of the valve actuating mechanism 50 for actuating the exhaust valve 48 via the stem end thereof.

The valve actuating mechanism 50 includes a valve spring 51 that resiliently urges the exhaust valve 48 in the closing direction (upward), an upper rocker shaft 53 supported by a block 52 provided on the cylinder head 4 and an upper rocker arm 54 rotatably supported by the upper rocker shaft 53. The upper rocker shaft 53 extends substantially perpendicularly to the crankshaft 8, and the upper rocker arm 54 extends substantially in parallel to the crankshaft 8. One end of the upper rocker arm 54 is provided with a socket 54*a* engaging the upper end 55*a* of the pushrod 55, and the other end of the upper rocker arm 54 is provided with a tappet adjuster 54*b* consisting of the screw which engages the stem end of the exhaust valve 48. The upper end 55*a* of the pushrod 55 is given with a semi-spherical shape, and the socket 54*a* of the rocker arm 54 receives the upper end 55*a* of the pushrod 55 in a complementary manner, allowing a certain sliding movement between them.

As shown in FIGS. 2 and 3, the pushrod 55 extends substantially vertically along a side of the cylinder block 3, and is received in a tubular rod case 56 having an upper end connected to the cylinder head 4 and a lower end connected to the lower valve case 17. In the illustrated embodiment, the rod case 56 extends along the exterior of the cylinder block 3.

Because the crankshaft 8 is offset from the cylinder axial line 3X (FIG. 1), as best shown in FIG. 3, the lower end of the rod case 56 is connected to a part of the upper wall of the lower valve case 17 laterally offset from the crankshaft 8. The lower valve chamber 18 receives the remaining part of the valve actuating mechanism 50 including a variable valve actuating mechanism 60 that allows the lift profile of the exhaust valve 48 to be varied as will be described hereinafter. The lower wall of the lower valve case 17 is provided with a drain hole 57 for expelling the lubricating oil in the lower valve chamber 18 which is usually closed by a drain plug 58.

As shown in FIG. 5 also, the variable valve actuating mechanism 60 includes a first cam 61 and a second cam 62 that are affixed on a part (the extension 14) of the crankshaft 8 extending in the lower valve chamber 18 one next to the other, a lower rocker shaft 63 supported by a side wall 7S of the crankcase 2 and the valve chamber lid 19 in parallel with the crankshaft 8, and a first rocker arm 64 and a second rocker arm 65 rotatably supported by the lower rocker shaft 63 for cooperation with the first and second cams 61 and 62, respectively. In other words, the extension 14 of the crankshaft 8 (or the right end thereof in FIG. 2) forms a camshaft 66 for the cams 61 and 62.

Figure 6:
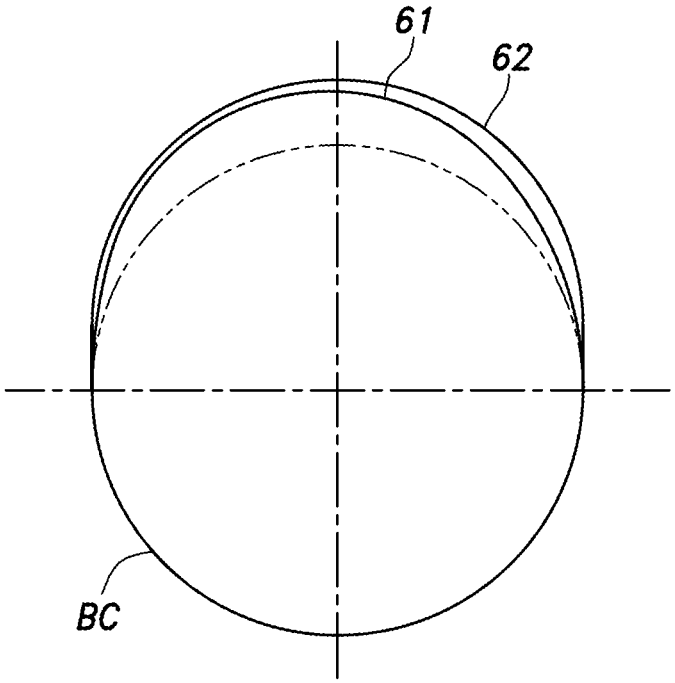
FIG. 6 is a diagram illustrating cam profiles.

As shown in FIG. 6, the first cam 61 is provided with a cam profile for a relatively small valve lift, and is typically used for starting the engine and in low-speed, light-load operations. On the other hand, the second cam 62 is provided with a cam profile for a relatively large valve lift as compared to the first cam 61, and is typically used for high-speed, heavy-load operations. The two cams 61 and 62 are provided with base circles BC which are coaxial to each other and have a same diameter, and the double-dot chain-dot line in FIG. 6 indicate the extension line of the base circles.

Figure 7A:
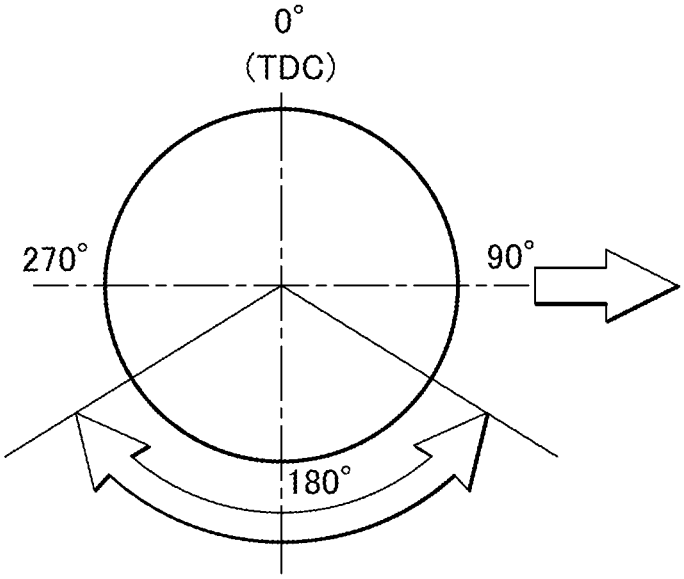
FIGS. 7*a* and 7*b* are diagrams illustrating exhaust valve opening angles caused by the two different cam profiles.
Figure 7B:
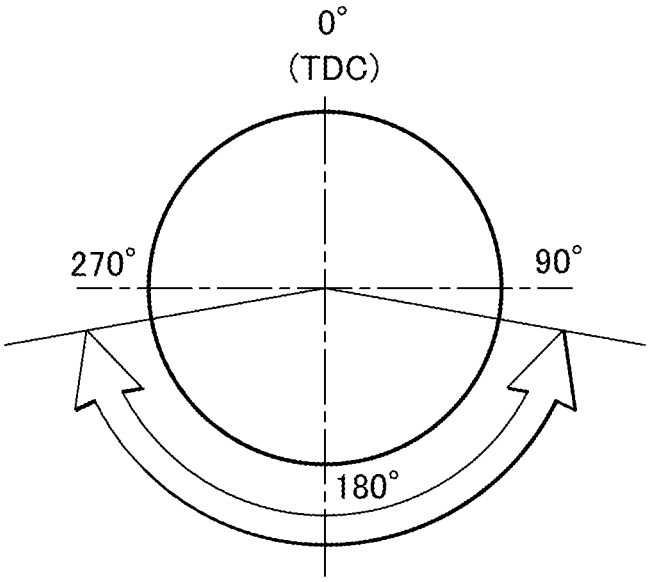

FIG. 7*a* shows the opening angle of the exhaust valve 48 caused by the first cam 61 and FIG. 7*b* shows the opening angle of the exhaust valve 48 caused by the second cam 62 where the angular position of the crankshaft 8 is zero degrees when the piston 22 is at the top dead center TDC. As can be seen from these diagrams, the effective cam profile of the first cam 61 is limited to a small angular range on either side of 180 degrees while the effective cam profile of the second cam 62 covers a range on either side of the 180 degree point broader than that of the first cam 61. In other words, the second cam 62 is configured to cause the exhaust valve 48 to open earlier (at a smaller angle) than the first cam 61, and to close later (at a larger angle) than the first cam 61.

As shown in FIGS. 3 and 5, the first rocker arm 64 includes a tubular portion 64*a* rotatably supported by the lower rocker shaft 63, a first arm 64*b* extending from the tubular portion 64*a* toward the crankshaft 8, a roller 64*c* pivotally supported by the free end of the first arm 64*b* to make a rolling contact with the first cam 61, a second arm 64*d* extending from the tubular portion 64*a* away from the first arm 64*b*, and a receiving portion 64*e* formed in the free end of the second arm 64*d* to support the lower end 55*b* of the pushrod 55. The lower end of the pushrod 55 is given with a semi-spherical shape, and the receiving portion 64*e* is formed as a recess complementary to the semi-spherical lower end of the pushrod 55 so as to receive the lower end of the pushrod 55 in a mutually slidable manner. The base end of the second arm 64*d* is provided with an engagement projection 64*f* projecting laterally or toward the second rocker arm 65.

Figure 8:
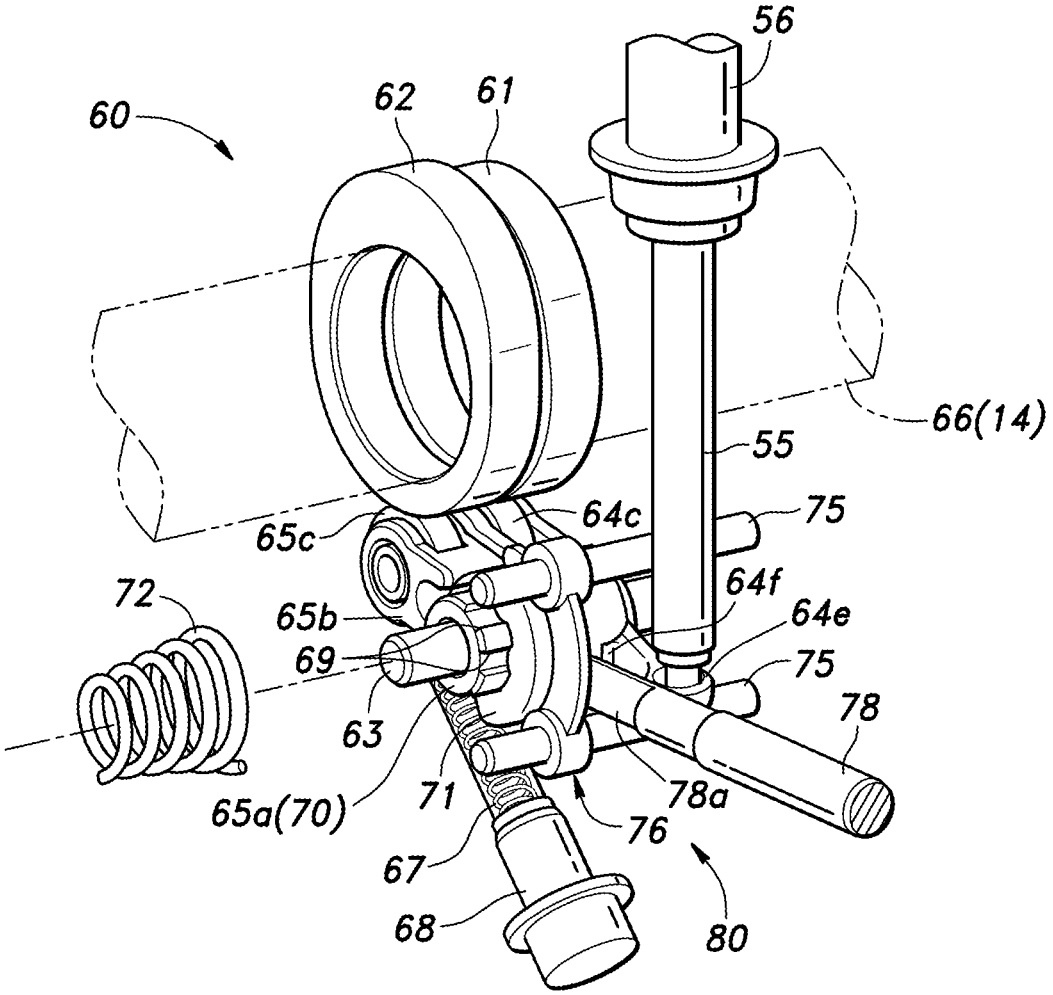
FIG. 8 is a fragmentary perspective view of a variable valve actuating mechanism according to the present invention.
Figure 9:
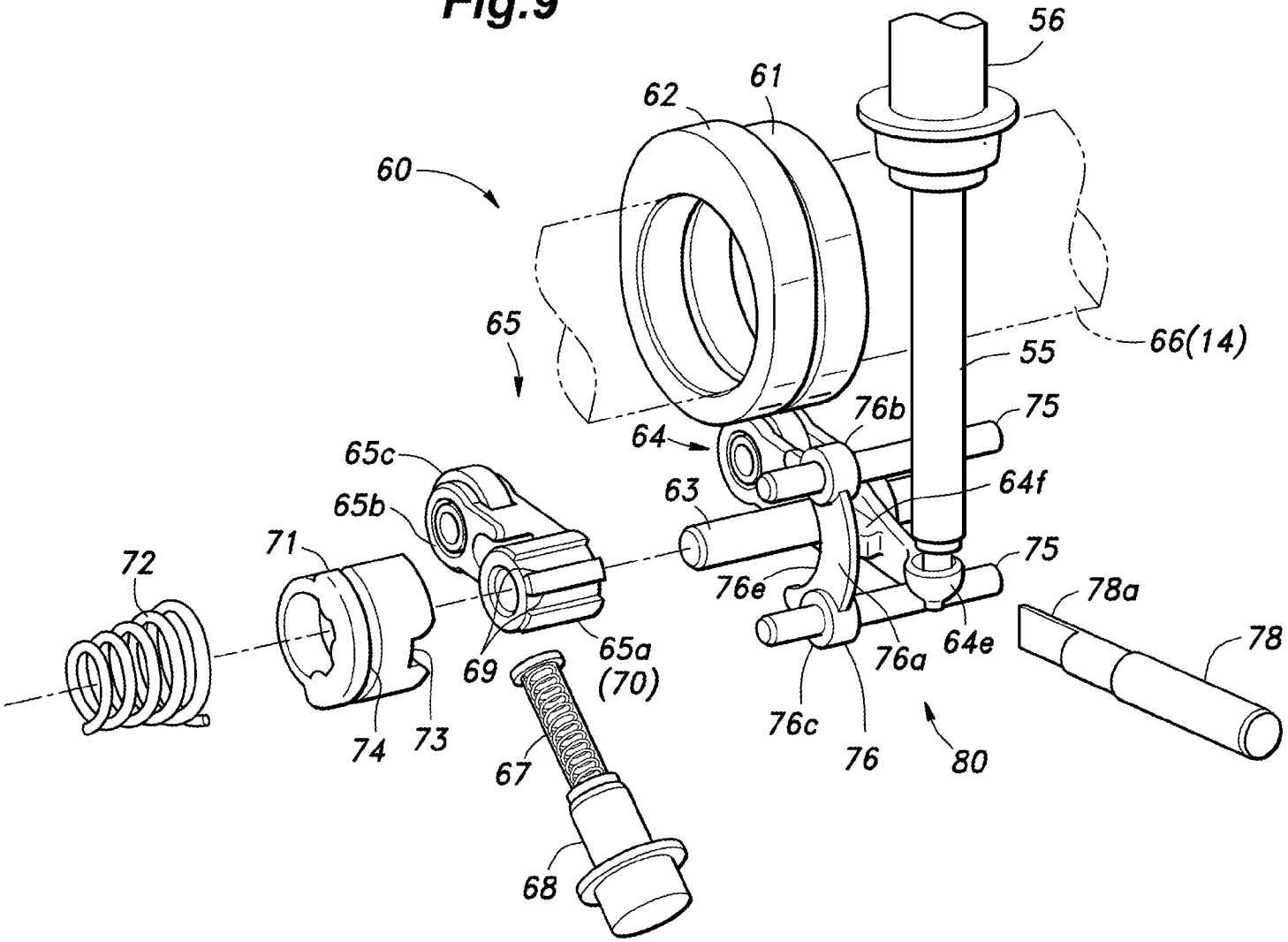
FIG. 9 is a fragmentary exploded perspective view of the variable valve actuating mechanism.

As shown in FIGS. 5, 8 and 9, the second rocker arm 65 includes a tubular portion 65*a* rotatably supported by the lower rocker shaft 63, a first arm 65*b* extending from the tubular portion 65*a* toward the crankshaft 8 and a roller 65*c* pivotally supported by the free end of the first arm 65*b* to make a rolling contact with the second cam 62. Between the first arm 65*b* of the second rocker arm 65 and the lower valve case 17 is interposed a lost motion spring 67 that urges the first arm 65*b* in the direction to cause the roller 65*c* to maintain a rolling contact with the second cam 62. The lower valve case 17 is provided with an adjustment screw 68 for adjusting the spring force of the lost motion spring 67.

The outer circumferential surface of the tubular portion 65*a* of the second rocker arm 65 is formed with a plurality of key grooves 69 extending in parallel with the lower rocker shaft 63. In other words, the tubular portion 65*a* of the second rocker arm 65 forms a spline shaft 70 coaxial with the lower rocker shaft 63. Furthermore, a tubular clutch member 71 is fitted on the tubular portion 65*a* of the second rocker arm 65 or the spline shaft 70 in an axially moveable but rotationally fast manner. A conical compression coil spring 72 is interposed between the clutch member 71 and the valve chamber lid 19 so that the clutch member 71 is resiliently urged toward the first rocker arm 64.

Figure 10A:
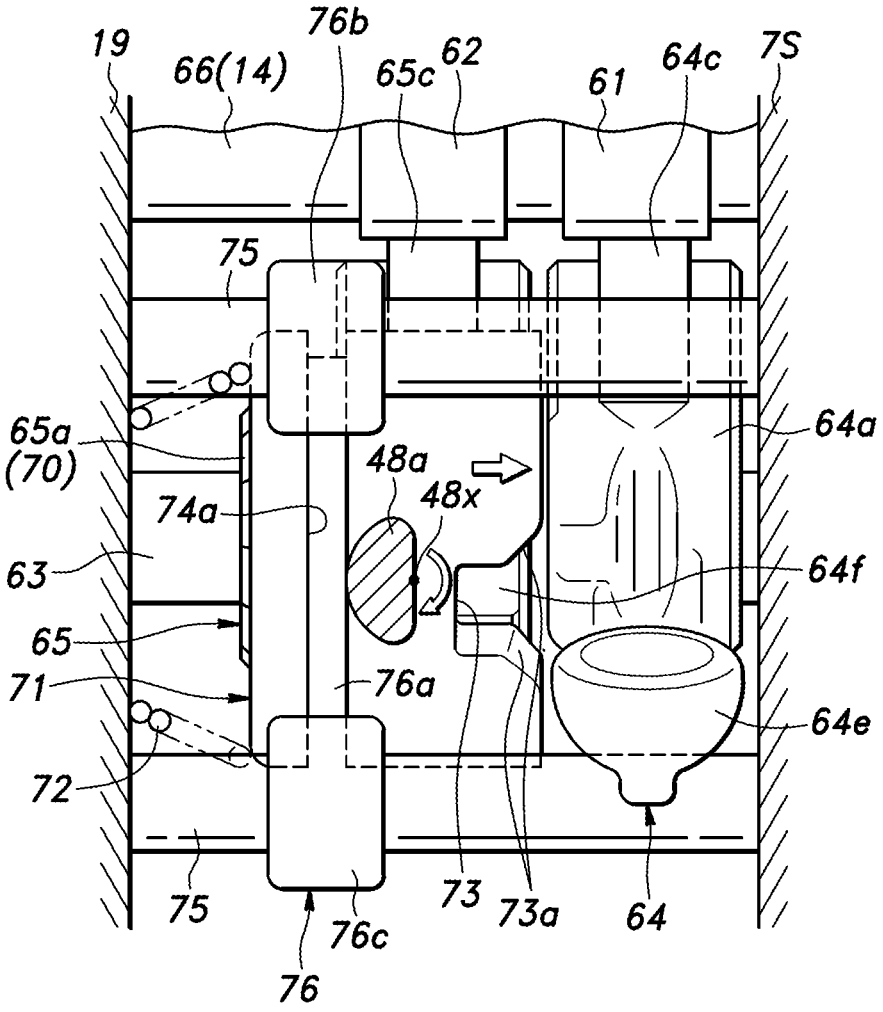
FIGS. 10*a* and 10*b* are enlarged fragmentary views of the variable valve actuating mechanism in a disengaged and engaged state of thereof.

As shown in FIG. 9, the axial end of the clutch member 71 adjacent to the first rocker arm 64 is provided with an engagement recess 73 opposing the first rocker arm 64. The engagement recess 73 is dimensioned and configured to receive the engagement projection 64*f* of the first rocker arm 64 when the first and second rocker arms 64 and 65 are engaging certain regions of the base circles BC of the first and second cams 61 and 62, respectively. As shown in FIG. 10*a*, the engagement recess 73 is provided with a bottom portion which is complementary to the engagement projection 64*f* and a pair of slopes 73*a* so as to define divergent surfaces defining an open end of the engagement recess 73.

Figure 10B:
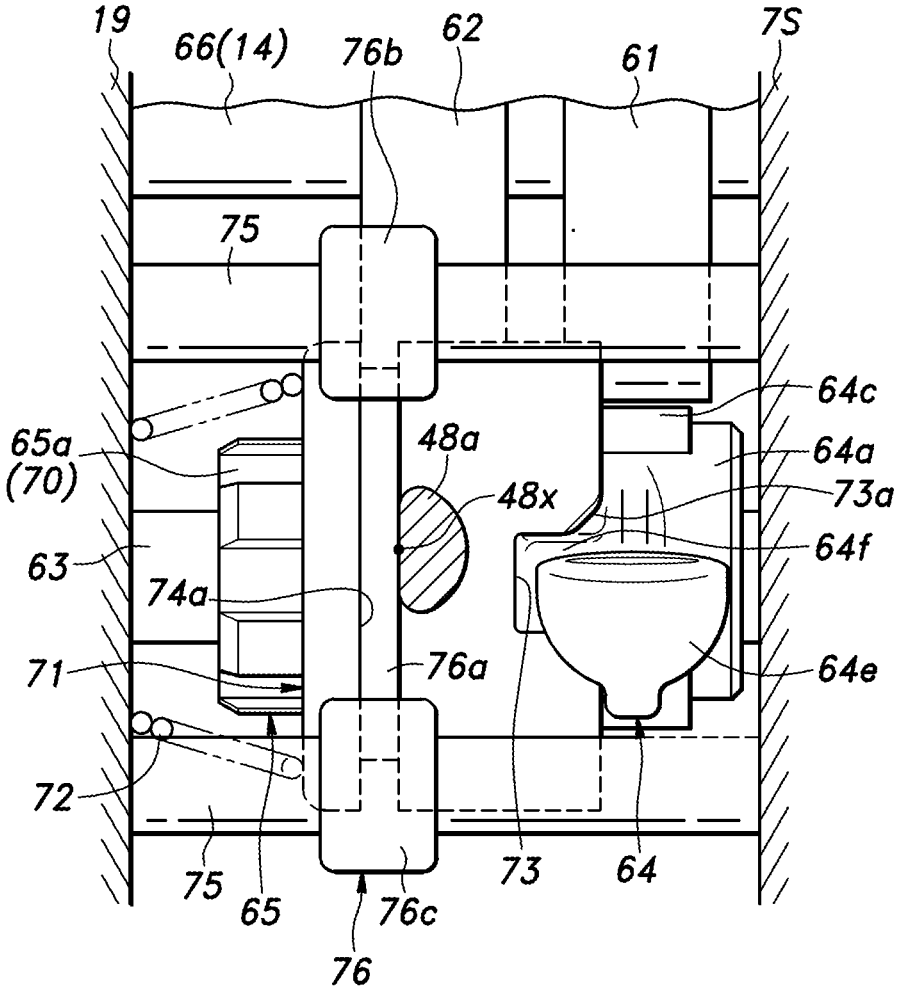

The clutch member 71 is moveable on the spline shaft 70 along the axial direction of the lower rocker shaft 63 between an engagement position shown in FIG. 10*b* where the engagement projection 64*f* is received by the engagement recess 73 and the clutch member 71 thereby engages the first rocker arm 64, and a disengagement position shown in FIG. 10*a* where the engagement projection 64*f* is dislodged from the engagement recess 73 and the clutch member 71 thereby releases the first rocker arm 64. When the clutch member 71 is in the engagement position shown in FIG. 10*b*, the first and second rocker arms 64 and 65 are integrally coupled with each other, and thereby rotate as a single body. On the other hand, when the clutch member 71 is in the disengagement position shown in FIG. 10*a*, the first and second rocker arms 64 and 65 are separated from each other, and are thereby allowed to rotate independently from each other. The base end of the first arm 65*b* is provided with an axial recess 65*g* facing the clutch member 71 so that the clutch member 71 may be permitted to move between the engaged position and the disengaged position axially along the corresponding splined tubular portion 65*a* without interfering with the first arm 65*b* of the second lower rocker arm 65.

As shown in FIGS. 8 and 9, the front side of the outer circumferential surface of the clutch member 71 facing away from the first arm 65*b* and the second cam 62 is formed with an engagement groove 74 extending in the circumferential direction or perpendicularly to the axial direction of the lower rocker shaft 63 and the spline shaft 70. A pair of guide rods 75 each having two ends are secured to the side wall 7S of the crankcase 2 and the valve chamber lid 19, respectively, similarly as the lower rocker shaft 63. The two guide rods 75 extend in parallel with the lower rocker shaft 63 adjacent to the clutch member 71, one above and the other below the second arm 64*d* of the first rocker arm 64.

The two guide rods 75 guide a linear movement of a shift plate 76 that limits the movement of the clutch member 71 along the spline shaft 70. The shift plate 76 includes a plate portion 76*a* having an arcuate inner edge 76*e* that corresponds to the outer circumferential surface of the clutch member 71, and a pair of tubular rod support portions 76*b* and 76*c* integrally provided in the upper and lower parts of the plate portion 76*a*, respectively, to slidably receive the guide rods 75. The shift plate 76 is assembled by passing the guide rods 75 through the rod support portions 76*b* and 76*c* while the arcuate inner edge 76*e* of the plate portion 76*a* is engaged by the engagement groove 74 of the clutch member 71.

As shown in FIGS. 5, 8 and 10, the side of the shift plate 76 facing the first rocker arm 64 as supported by the guide rods 75 is engaged by a control shaft 78 which extends in the fore and aft direction (perpendicular to the axial direction of the spline shaft 70), and is rotatably supported by the crankcase 2 for limiting the movement of the shift plate 76 toward the first rocker arm 64. An electric motor 79 mounted on the front wall of the lower valve case 17 rotatively actuates the control shaft 78. A fourth seal member S4 is interposed between the control shaft 78 and the surrounding edge of the front wall of the lower valve case 17 so that the air tightness of the lower valve chamber 18 may be ensured.

The free end 78*a* or inner end of the control shaft 78 is provided with a semi-circular cross section so as to define a cam surface having a varying radius as measured from the rotational center 78X along the circumference thereof. When the flat side of the free end 78*a* of the control shaft 78 engages the plate portion 76*a* of the shift plate 76, the engagement projection 64*f* is received by the engagement recess 73 of the clutch member 71 under the spring force of the conical compression coil spring 72 so that the first rocker arm 64 and the second rocker arm 65 are integrally joined to each other by the clutch member 71.

When the control shaft 78 is rotatively actuated by the electric motor 79 until the arcuate surface of the free end 78*a* of the control shaft 78 engages the plate portion 76*a* of the shift plate 76, the clutch member 71 is forced toward the second rocker arm 65 via the shift plate 76 against the biasing force of the conical compression coil spring 72. At this time, the shift plate 76 is slidably received in a circumferentially extending engagement groove 74 of the clutch member 71 from the side of engagement groove 74 facing the first rocker arm 64 so that the movement of the clutch member 71 under the resilient biasing force of the conical compression coil spring 72 toward the first rocker arm 64 (the engagement position) is prevented while the rotational movement of the clutch member 71 is permitted.

Thus, the shift plate 76 and the control shaft 78 jointly form a limiting mechanism 80 that limits the movement of the clutch member 71 toward the engagement position while permitting the rotational movement of the clutch member 71.

The mode of operation of this variable valve actuating mechanism 60 is described in the following with reference to FIG. 10. As shown in FIG. 10*a*, when the arcuate side of the control shaft 78 is directed toward the shift plate 76, the shift plate 76 retains the clutch member 71 at the disengaged position on the left hand side of the drawing so that the engagement projection 64*f* of the first rocker arm 64 is not received in the engagement recess 73 of the clutch member 71. In this state, the first rocker arm 64 which is not coupled with the second rocker arm 65 by the clutch member 71 undergoes a rocking motion following the cam profile of the first cam 61. The second rocker arm 65 also undergoes a rocking motion following the cam profile of the second cam 62, but this motion is a "lost motion" which is not transmitted to the pushrod 55. At this time, the lost motion spring 67 resiliently urges the roller 65*c* against the second cam 62. The clutch member 71 rotates fast with the second rocker arm 65 while the plate portion 76*a* of the shift plate 76 is slidably received in the side of the engagement groove 74 facing the first rocker arm 64.

When the control shaft 78 is rotatively actuated in the direction indicated by the white arrow until the chord side (flat side) thereof faces the shift plate 76 as shown in FIG. 10*b*, the clutch member 71 under the biasing force of the conical compression coil spring 72 is forced to the engaged position on the right hand side of the drawing along with the shift plate 76 which is engaged by the clutch member 71 so that the engagement projection 64*f* of the first rocker arm 64 is received in the engagement recess 73 of the clutch member 71. In this state, the first rocker arm 64 which is coupled with the second rocker arm 65 by the clutch member 71 undergoes a rocking motion following the cam profile of the second cam 62 demonstrating a relatively large cam lift. In this case also, the clutch member 71 rotates fast with the second rocker arm 65 while the plate portion 76*a* of the shift plate 76 is slidably received in the engagement groove 74.

Conversely, when the control shaft 78 is turned from the angular position illustrated in FIG. 10*b* back to the angular position illustrated in FIG. 10*a* where the arcuate side thereof is directed to the shift plate 76, the shift plate 76 which is guided by the two guide rods 75 forces the clutch member 71 in the leftward direction in the drawing against the spring force of the conical compression coil spring 72 so that the clutch member 71 is disengaged from the first rocker arm 64.

The engine E described above operates as described in the following at the time of start-up. Prior to starting the engine, the limiting mechanism 80 of the variable valve actuating mechanism 60 is in the state illustrated in FIG. 10*a* where the clutch member 71 in the disengaged position is prevented from moving toward the engaged position by the control shaft 78. In this state, because the clutch member 71 is disengaged from the first rocker arm 64, the exhaust valve 48 is actuated by the first rocker arm 64 via the pushrod 55 and the upper first rocker arm 64 so as to be actuated by the cam profile of the first cam 61.

Referring to FIG. 1, in the upward stroke of the piston 22, owing to the depressurization of the crank chamber 2*a*, the reed valve 33 opens. As a result, a mixture of the fresh air metered by the throttle valve 34*b* and the fuel injected into this fresh air by the fuel injector 35 is drawn into the crank chamber 2*a* via the reed valve 33 and the intake port 32. Meanwhile, the mixture in the cylinder bore 3*a* is compressed by the piston 22, and is ignited by the spark from the spark plug 47 when the piston 22 is near the top dead center.

The piston 22 then undergoes a downward stroke, and because the reed valve 33 is closed at this time, the mixture in the crank chamber 2*a* is prevented from flowing back to the throttle valve 34*b*, and compressed. During the downward stroke of the piston 22, before the piston 22 opens the scavenging port 43, the exhaust valve 48 actuated by the valve actuating mechanism 50 according to the cam profile of the first cam 61 opens the exhaust port 46. The open period (crank angle) of the exhaust port 46 is shown in FIG. 7*a*. Once the piston 22 opens the scavenging port 43, the compressed mixture is introduced into the cylinder bore 3*a* (combustion chamber 44) via the scavenging port 43. The combustion gas in the combustion chamber 44 is displaced by this mixture, and is expelled from the exhaust port 46 while part of the combustion gas remains in the combustion chamber 44 as EGR gas. The valve opening timing of the exhaust valve 48 is determined such that the amount of the EGR gas remaining in the combustion chamber 44 is great enough for the self-ignition of the mixture to take place owing to the rise in the temperature of the mixture in the combustion chamber 44 under compression with the increase in the amount of the EGR gas.

When the piston 22 undergoes an upward stroke once again, the piston 22 closes the scavenging port 43, and, thereafter, the exhaust valve 48 actuated by the first cam 61 closes the exhaust port 46. As a result, the mixture in the cylinder bore 3*a* (combustion chamber 44) is compressed while the crank chamber 2*a* is depressurized, causing the mixture to be drawn thereinto via the reed valve 33. Once the engine E is brought into a stable operation, the mixture is self-ignited as the piston 22 comes near the top dead center, and the combustion gas created by the resulting combustion pushes down the piston 22.

The engine E thus performs a two-stroke operation. In particular, spark ignition using the spark plug 47 is required at the time of start up, but once the engine starts operating in a stable manner, a two-stroke operation based on a homogeneous charge compression ignition is performed. The scavenging flow from the scavenging port 43 to the exhaust port 46 via the cylinder bore 3*a* is guided along a relatively straight path, or the so-called "uni-flow scavenging" can be achieved.

When the fuel injection from the fuel injector 35 is increased, and the intake flow rate is increased by increasing the opening angle of the throttle valve 34*b*, or when a high-load operation is being performed, the electric motor 79 turns the control shaft 78. As a result, the limiting mechanism 80 of the variable valve actuating mechanism 60 is brought to the condition illustrated in FIG. 10*b*, or the clutch member 71 is allowed to move to the engaged position under the spring force of the conical compression coil spring 72, and the engagement projection 64*f* of the first rocker arm 64 is received in the engagement recess 73. Once this state is reached, because the clutch member 71 is engaged by the first rocker arm 64, the exhaust valve 48 which is actuated by the first rocker arm 64 via the pushrod 55 and the upper rocker arm 54 is moved according to the cam profile of the second cam 62 which involves a generally greater cam lift than that of the first cam 61.

In a high-speed or high-load operation, the exhaust valve 48 opens over a crank angle or a time period shown in FIG. 7*b*. In other words, during the downward stroke of the piston 22, the exhaust port 46 is opened at an earlier timing than at the time of start up, or in a low-speed or low-load operation. During the upward stroke of the piston 22, the exhaust port 46 is closed at a later timing than at the time of start up, or in a low-speed or low-load operation. Therefore, the amount of the EGR gas remaining in the combustion chamber is less than that at the time of start up, or in a low-speed or low-load operation.

By changing the opening/closing timing of the exhaust valve 48 in a high-speed or high-load operation, the replacement of gas can be performed in an optimum fashion for each given operating condition. When a fuel having a poor engine start property (poor ignition immediately after the start-up) is used, a relatively large amount of EGR gas may be allowed to remain in the combustion chamber for a short time period following the start-up so that the engine may be started with ease owing to the increase in the temperature in the cylinder.

Thus, the clutch member 71 is axially slidably mounted on the spline shaft 70 which is integrally formed with the second rocker arm 65 in a coaxial relationship to the lower rocker shaft 63 so as to be moveable between the engaged position for engaging the first rocker arm 64 and the disengaged position for disengaging from the first rocker arm 64, and the limiting mechanism 80 can selectively retain the clutch member 71 at the disengaged position by restricting the movement of the clutch member 71 towards the engaged position against the resilient force of the conical compression coil spring 72 which normally urges the clutch member 71 toward the engaged position. As a result, the variable valve actuating mechanism that can switch between the drive by the first cam 61 and the drive by the second cam 62 can be achieved by using a highly simple structure.

In the illustrated embodiment, the limiting mechanism 80 includes a shift plate 76 provided in the crankcase 2 so as to be moveable along the lower rocker shaft 63 while engaging at least the side surface 74*a* of the clutch member 71 facing the engaged position thereof, and a control shaft 78 rotatably supported by the crankcase 2 around the axial center of the control shaft 78 extending substantially perpendicularly to the lower rocker shaft 63 and provided with a free end 78*a* serving as a cam that engages the side of the shift plate 76 facing the engagement position. Thereby, the contact area between the shift plate 76 and the clutch member 71 that rotates with the second rocker arm 65 can be minimized so that the friction between them can be minimized, and the localized wear in the contact area can be minimized.

In the illustrated embodiment, the engagement groove 74 extends circumferentially on the outer circumferential surface of the clutch member 71, and the arcuate inner edge 76*e* of the plate portion 76*a* of the shift plate 76 is received in the engagement groove 74 so that the clutch member 71 and the shift plate 76 are engaged with each other via a relatively large contact area. Furthermore, the clutch member 71 which is urged by the conical compression coil spring 72 can be retained by the shift plate 76 in a stable manner. Therefore, the clutch member 71 is subjected to a minimum torque or a force that could tilt the clutch member 71 can be minimized so that the resistance to the shifting movement of the clutch member 71 (in the axial direction) can be minimized.

In the illustrated embodiment, the shift plate 76 is guided by the two guide rods 75 that are located on either side of the plate portion 76*a* of the shift plate 76 (above and below the arcuate inner edge 76*e* in the illustrated embodiment), respectively, so that the attitude of the plate portion 76*a* is maintained in a stable manner throughout the entire range of the linear movement thereof by the two guide rods 75 via the tubular rod support portions 76*b* and 76*c* of the shift plate 76. Therefore, the tilting of the shift plate 76 can be minimized so that the resistance to the shifting movement of the clutch member 71 (in the axial direction) can be minimized.

In the illustrated embodiment, the first rocker arm 64 is provided with the engagement projection 64*f* that protrudes toward the second rocker arm 65, and the clutch member 71 is provided with the engagement recess 73 that opens toward the engagement projection 64*f* and can receive the engagement projection 64*f*. Furthermore, the engagement recess 73 is substantially complementary to the engagement projection 64*f*, and is provided with the slopes 73*a* or tapered surfaces that are divergent toward the opening of the engagement recess 73. Therefore, the engagement projection 64*f* can be received in the engagement recess 73 without fail when the clutch member 71 moves to the engaged position, and can be dislodged from the engagement recess 73 without fail when the clutch member 71 moves to the disengaged position.

In the illustrated embodiment, the variable valve actuating mechanism 60 includes the exhaust valve, and the engine E consists of an OHV, uni-flow type, two-stroke engine where the camshaft 66 is integrally formed with the crankshaft 8. Therefore, no separate camshaft 66 is required, and the engine may be constructed as a highly compact unit.

However, the engine may also consist of an OHV, four-stroke engine which includes an intake valve and an exhaust valve both provided in the cylinder head without departing from the spirit of the present invention.

Although the present invention has been described in terms of a preferred embodiment thereof, it is obvious to a person skilled in the art that various alterations and modifications are possible without departing from the scope of the present invention which is set forth in the appended claims.

The contents of the original Japanese patent application on which the Paris Convention priority claim is made for the present application as well as the contents of the prior art references mentioned in this application are incorporated in this application by reference.

The invention claimed is:

1. A variable valve actuating mechanism for an OHV engine, comprising:

a camshaft rotatably supported by a crankcase to be rotatively actuated by a crankshaft of the engine;

a first cam carried by the camshaft;

a first lower rocker arm pivotally supported by a lower rocker shaft supported by the crankcase, and configured to be actuated by the first cam at a first end thereof;

a pushrod having a lower end engaged by a second end of the first lower rocker arm;

an upper rocker arm pivotally supported by an upper rocker shaft supported by a cylinder head and having a first end engaged by an upper end of the pushrod;

an engine valve provided in the cylinder head, and configured to be actuated by a second end of the upper rocker arm;

a second cam carried by the camshaft coaxially to and adjacent to the first cam and having an at least partly greater cam profile than the first cam;

a second lower rocker arm pivotally supported by the lower rocker shaft adjacent to the first lower rocker arm, and configured to be actuated by the second cam at a first end thereof;

a clutch member mounted on the second rocker arm in an axially slidable and rotationally fast manner, the clutch member being axially moveable between an engaged position and a disengaged position, the clutch member being provided with an engagement feature which engages a corresponding engagement feature of the first lower rocker arm for a joint pivotal movement of the first and second lower rocker arms when the clutch member is at the engaged position; and an actuator for causing the clutch member to move axially between the engaged position and the disengaged position.

2. The variable valve actuating mechanism according to claim 1, wherein the actuator comprises a shift member guided for an axial movement and engaging the clutch member for a joint axial movement, a spring member urging the clutch member toward one of the engaged and disengaged positions, and a cam configured to cause an axial movement of the shift member toward the other of the engaged and disengaged positions against a spring force of the spring member.

3. The variable valve actuating mechanism according to claim 2, wherein the shift member comprises a shift plate having an inner arcuate edge, and the clutch member is provided with a circumferential groove on an outer circumference thereof that receives the inner arcuate edge of the shift plate for the joint axial movement.

4. The variable valve actuating mechanism according to claim 3, wherein the shift plate is guided by a pair of guide rods that guide the shift plate at positions thereof located on either side of the arcuate edge thereof.

5. The variable valve actuating mechanism according to claim 1, wherein the engagement feature of the clutch member comprises an axial engagement recess, and the corresponding engagement feature of the first lower rocker arm comprises an axial projection configured to be received in the engagement recess in an at least partly complementary manner, the engagement recess being provided with a pair of slopes on either side of an open end thereof.

6. The variable valve actuating mechanism according to claim 5, wherein the clutch member is provided with a splined inner bore, and the second lower rocker arm is provided with a corresponding splined tubular portion which is received in the splined inner bore, the second lower rocker arm being provided with an axial recess for permitting the clutch member to move between the engaged position and the disengaged position axially along the corresponding splined tubular portion without interfering with the second lower rocker arm.

7. The variable valve actuating mechanism according to claim 1, further comprising a lost motion spring that urges the first end of the second lower rocker arm against the second cam.

8. The variable valve actuating mechanism according to claim 1, wherein the engine valve comprises an exhaust valve, the OHV engine consists of a uni-flow type, two-stroke engine, and the camshaft is integrally formed with the crankshaft.

* * * * *